US009010456B2

(12) United States Patent
Sieber et al.

(10) Patent No.: US 9,010,456 B2
(45) Date of Patent: Apr. 21, 2015

(54) HAND-HELD POWER TOOL

(75) Inventors: Kurt Sieber, Leinfelden-Echterdingen (DE); Otto Baumann, Leinfelden-Echterdingen (DE); Elisabeth Michl, Waldenbuch (DE); Hardy Schmid, Stuttgart (DE); Holger Ruebsaamen, Stuttgart (DE); Tobias Herr, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 721 days.

(21) Appl. No.: 13/139,775

(22) PCT Filed: Oct. 16, 2009

(86) PCT No.: PCT/EP2009/063524

§ 371 (c)(1),
(2), (4) Date: Jun. 15, 2011

(87) PCT Pub. No.: WO2010/072433

PCT Pub. Date: Jul. 1, 2010

(65) Prior Publication Data

US 2011/0247848 A1 Oct. 13, 2011

(30) Foreign Application Priority Data

Dec. 16, 2008 (DE) ..... 10 2008 054 692

(51) Int. Cl.
*B25D 16/00* (2006.01)
*B25D 11/12* (2006.01)

(52) U.S. Cl.
CPC ..... *B25D 16/006* (2013.01); *B25D 11/125* (2013.01); *B25D 2211/006* (2013.01); *B25D 2216/0015* (2013.01); *B25D 2216/0023* (2013.01); *B25D 2216/0038* (2013.01)

(58) Field of Classification Search
CPC ..... B25D 16/00; B25D 16/006; B25D 2216/0023; B25D 2211/006; B25D 11/12; B25D 11/062
USPC ..... 173/48, 104, 109, 201
See application file for complete search history.

(56) References Cited

U.S. PATENT DOCUMENTS 3,828,863 A * 8/1974 Bleicher et al. ..... 173/48
4,529,044 A * 7/1985 Klueber et al. ..... 173/48

(Continued)

FOREIGN PATENT DOCUMENTS

CN 2661382 Y 12/2004
CN 1907611 A 2/2007

(Continued)

OTHER PUBLICATIONS

International Search Report corresponding to PCT Application No. PCT/EP2009/063524, mailed Jan. 26, 2010 (German and English language document) (5 pages).

*Primary Examiner* — Andrew M Tecco
(74) *Attorney, Agent, or Firm* — Maginot, Moore & Beck LLP

(57) ABSTRACT

A hand-held power tool, particularly a hammer drill, includes a work spindle, a hand-held power tool housing and an intermediate shaft, which is arranged in parallel to the work spindle and mounted in an axially displaceable manner for changing the operational mode, and a tooth sleeve, which is provided to transfer a torque to the intermediate shaft. The tooth sleeve is fixed in the axial direction by means of the hand-held power tool housing.

14 Claims, 7 Drawing Sheets

(56) References Cited

U.S. PATENT DOCUMENTS

| | | | | |
|---|---|---|---|---|
| 6,460,627 | B1 * | 10/2002 | Below et al. | 173/48 |
| 6,666,284 | B2 * | 12/2003 | Stirm | 173/97 |
| 7,287,600 | B2 * | 10/2007 | Braun | 173/48 |
| 7,296,635 | B2 * | 11/2007 | Droste | 173/48 |
| 7,591,324 | B2 * | 9/2009 | Saur | 173/48 |
| 2006/0289181 | A1 * | 12/2006 | Braun | 173/48 |
| 2007/0193756 | A1 * | 8/2007 | Saur | 173/48 |
| 2009/0308626 | A1 * | 12/2009 | Saur | 173/48 |

FOREIGN PATENT DOCUMENTS

| | | | |
|---|---|---|---|
| CN | 101100006 | A | 1/2008 |
| DE | 38 191 25 | A1 | 12/1989 |
| DE | 42 16 808 | A1 | 11/1993 |
| DE | 10 2004 026 845 | A1 | 12/2005 |
| DE | 10 2006 029 363 | A1 | 1/2008 |
| DE | 10 2006 056 853 | A1 | 6/2008 |
| EP | 1 101 570 | A2 | 5/2001 |
| JP | 01274970 | A | 11/1989 |

* cited by examiner

HAND-HELD POWER TOOL

This application is a 35 U.S.C. §371 National Stage Application of PCT/EP2009/063524, filed Oct. 16, 2009, which claims the benefit of priority to Serial No. 10 2008 054 692.5, filed Dec. 16, 2008 in Germany, the disclosures of which are incorporated herein by reference in their entirety.

BACKGROUND

The disclosure relates to a hand-held power tool as described herein.

A hand-held power tool, in particular a hammer drill, having a work spindle, a hand-held power tool housing and an intermediate shaft that is arranged parallelwise in relation to the work spindle and mounted in an axially displaceable manner for a change of operating mode, and having a toothed sleeve provided to transmit a torque to the intermediate shaft, has already been proposed in DE 38 19 125 A1.

SUMMARY

The disclosure relates to a hand-held power tool, in particular a hammer drill, having a work spindle, a hand-held power tool housing and an intermediate shaft that is arranged parallelwise in relation to the work spindle and mounted in an axially displaceable manner for a change of operating mode, and having a toothed sleeve provided to transmit a torque to the intermediate shaft.

It is proposed that the toothed sleeve is fixed in the axial direction by means of the hand-held power tool housing. By a "work spindle" is also to be understood, in particular, a hammer tube in which an element provided for generating an impulse is guided. The work spindle is rotatable and in this case can be realized so as to be axially fixed and/or at least partially axially movable and/or of multiple parts. By a "change of operating mode" is to be understood, in particular, a switchover between two operating modes, in particular between an impact drilling operation, a drilling operation and/or a chiseling operation. By an "operating mode" are to be understood, in particular, the chiseling operation, the impact drilling operation and/or the drilling operation. In the case of a chiseling operation, a tool executes a motion along a main working direction. In the case of a drilling operation, the tool executes a rotary motion about a rotation axis, parallelwise in relation to the main working direction. In the case of an impact drilling operation, the tool executes the two motions simultaneously. By a "main working direction" is to be understood, in particular, a direction in which the hand-held power tool is normally moved during a working process, for example directly during a drilling process. By "provided" is to be understood, in particular, specially equipped and/or designed. By a "toothed sleeve" is to be understood, in particular, an element that at least partially surrounds a cavity and/or has at least one toothed element that preferably consists of teeth and tooth spaces and is realized as a spur gear, for transmitting a torque. By the term "transmit a torque" is also to be understood, in particular, transmission of a power by means of a rotary motion. By "fixed in the axial direction" is to be understood, in particular, immovable along an axis. In particular, in the case of a change of operating mode, the toothed sleeve remains unmoved in the axial direction in relation to a hand-held power tool housing and/or in relation to a motor shaft. By a "hand-held power tool" is to be understood in this connection, in particular, in addition to a hammer drill, also an impact drill and/or another hand-held power tool considered appropriate by persons skilled in the art. Owing to the design of the hand-held power tool according to the disclosure, the toothed sleeve fixed in the axial direction enables wearing of the toothed sleeve and/or of the motor shaft to be minimized in an effective manner and, advantageously, enables skewing of the toothed sleeve and/or of the motor shaft and/or of the intermediate shaft upon switching under load to be prevented.

Further, the hand-held power tool has a motor shaft, which is arranged parallelwise in relation to the work spindle. Advantageously, the toothed sleeve is fixed in the axial direction relative to the motor shaft. By "arranged parallelwise" is to be understood in this connection, in particular, that rotation axes of the work spindle, of the motor shaft and of the intermediate shaft are aligned parallelwise in relation to one another. Alternatively, the hand-held power tool can have a motor shaft that is arranged perpendicularly in relation to the work spindle. The motor shaft arranged parallelwise in relation to the work spindle enables an advantageous small structural height to be achieved.

Furthermore proposed is a switching element, which is axially displaceable relative to the toothed sleeve for at least one change of operating mode, whereby, advantageously, in the case of at least two operating modes such as, for example, in the case of a drilling operation and an impact drilling operation, a reliable and rotationally fixed connection between the intermediate shaft and the switching element is possible.

Further, the hand-held power tool has a coupling element, which connects at least the switching element and the toothed sleeve to one another in a rotationally fixed manner. By a "coupling element" is to be understood, in particular, a device that connects two elements to one another in a rotationally fixed manner irrespective of an axial displacement of the elements towards one another or away from one another.

Particularly advantageously, the coupling element is realized as a splined-shaft profile. Other realizations that are considered appropriate by persons skilled in the art and that perform a like function are also possible. Through the coupling element, advantageously, the switching element and the toothed sleeve are connected to one another, in all positions of the switching element and of the intermediate shaft, by a rotationally fixed connection.

In addition, it is proposed that the toothed sleeve at least partially surrounds the switching element. By "at least partially surround" is to be understood, in particular, that the switching element is arranged at least partially in the cavity surrounded by the toothed sleeve, whereby, advantageously, a required structural space can be reduced.

In a further development, a spring element is proposed, which is provided to displace at least the switching element at least in the case of a change of operating mode, whereby a simple design is possible. In particular, the spring element displaces the switching element in the case of a change from the drilling operation to the impact drilling operation. Instead of a spring element realized as a helical spring, another device considered appropriate by persons skilled in the art such as, for example, a rubber element, a hydraulic, magnetic or pneumatic device, can also be used to displace the switching element.

Furthermore proposed is a spring element that at least partially surrounds the toothed sleeve, whereby a particularly small amount of structural space is required for a transmission arrangement.

Further, a connecting element is proposed, which connects the intermediate shaft and the switching element to one another in a rotationally fixed manner in at least one operating mode. By a "connecting element" is to be understood, in particular, a device that, in at least one operating mode, prevents a rotatory relative motion of two elements, in this case the intermediate shaft and the switching element, in relation to one another. In particular, the connecting element prevents a rotatory relative motion of the two elements in relation to one another in a drilling operation and in an impact drilling operation. In at least one other operating mode, in particular in a chiseling operation, the connecting element renders possible a free running, i.e. a rotatory relative motion in which the two elements can be turned against one another. The first connecting element enables an advantageous rotary motion of the tool to be achieved during at least one operating mode.

In addition it is proposed that the connecting element is opened in the case of a chiseling operation. Advantageously, the connecting element that connects the intermediate shaft and the switching element to one another in a rotationally fixed manner in at least one operating mode is opened in the case of a chiseling operation. By "opened" it is to be understood in this connection, in particular, that the two elements connected by the connecting element are connected to one another in a rotationally fixed manner in the case of a drilling operation and an impact drilling operation and now have a free running in relation to one another. Advantageously, the opened connecting element enables an application range of the hand-held power tool to be extended.

Furthermore, a second connecting element is proposed, which, in at least one operating mode, transmits at least a torque from the switching element to a stroke generator, whereby an advantageous impact motion of the tool can be achieved. The stroke generator in this case can be realized, for example, by means of a wobble drive and/or an eccentric drive.

In a further development, it is proposed that the second connecting element is opened in the case of a drilling operation, whereby, advantageously, an application range of the hand-held power tool can be extended.

Further, an additional bearing element is proposed, by means of which at least the toothed sleeve is seated. By "additional bearing element" is to be understood, in particular, a bearing element that can be produced separately from elements that adjoin when in an integrated state, such as, in particular, a housing element and/or the toothed sleeve. Advantageously, the additional bearing element is realized as a stud. By the term "seated by means of the bearing element" is to be understood in this connection, in particular, that the bearing element diverts and/or supports linear forces occurring at least in the case of a seating. In this case, a bearing renders possible differently oriented motions, in this case a differing axial rotary motion of the toothed sleeve and of the bearing element. Various bearings considered appropriate by persons skilled in the art may be used, such as plain bearings, rolling bearings, sheet-metal cups, needle bearings and/or deep-groove ball bearings. The additional bearing element enables the toothed sleeve to be seated in a structurally simple manner.

In addition, it is proposed that the additional bearing element is at least connected to a housing element in a rotationally fixed manner, whereby the hand-held power tool is easily assembled.

In a further development, a journal is proposed, which is realized so as to be integral with a housing element and by means of which at least the toothed sleeve is seated. By "integral" in this connection is to be understood, in particular, that the journal and the housing element are produced from a common blank. An advantageous saving in components is thereby achieved.

Furthermore, a bearing is proposed, which seats at least the toothed sleeve in a stroke generator. By the term "seats in a stroke generator" is to be understood, in particular, that forces occurring in the case of a seating are diverted and/or supported by means of at least one component of the stroke generator, preferably a transmission element of the stroke generator. In particular, the bearing element is to seat the toothed sleeve in the stroke generator to which the second connecting element transmits a torque. Particularly advantageously, the seating of the toothed sleeve in the stroke generator enables structural space to be saved.

Further, at least one bearing is proposed, which is arranged within the toothed sleeve and which axially and/or radially seats the toothed sleeve. By "within the toothed sleeve" is to be understood, in particular, that the toothed sleeve at least partially surrounds the bearing. Additional structural space can be saved as a result of the bearing being within the toothed sleeve.

In a further development, it is proposed that the toothed sleeve has a journal. Advantageously, the journal is connected to the toothed sleeve in a rotationally fixed manner. The journal of the toothed sleeve enables a bearing to be arranged advantageously within the hand-held power tool housing.

BRIEF DESCRIPTION OF THE DRAWINGS

Further advantages are given by the following description of the drawings. Nine exemplary embodiments of the disclosure are represented in the drawings, three exemplary embodiments relating, in particular, to a device for transmitting a torque, and six exemplary embodiments relating to a seating of a toothed sleeve. The drawings, the description and the claims contain numerous features in combination. Expediently, persons skilled in the art will also consider the features individually and combine them into appropriate, further combinations. In particular, the exemplary embodiments one to three can be combined with the exemplary embodiments four to nine.

In the drawing.

DETAILED DESCRIPTION

Figure 1:
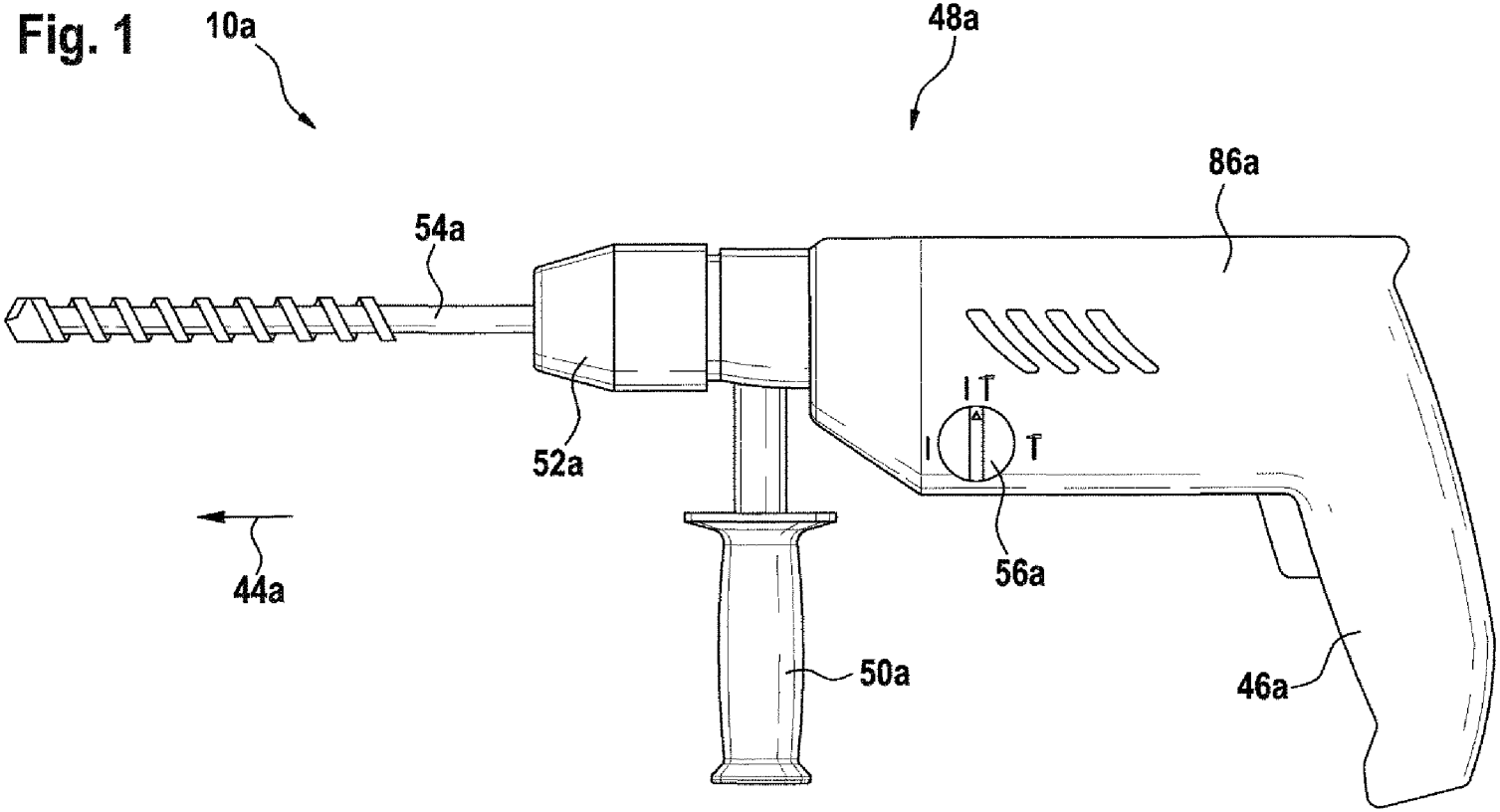
FIG. 1 shows a schematic representation of a hand-held power tool realized as a hammer drill.

FIG. 1 shows a schematic representation of a first exemplary embodiment of a hand-held power tool 10*a*, realized as a hammer drill, having a pistol-shaped hand-held power tool housing 86*a*. The hand-held power tool 10*a* has a main handle

46*a*, which is angled in relation to a main working direction 44*a* and which is realized so as to be integral with the hand-held power tool housing 86*a*. In a front region 48*a* of the hand-held power tool 10*a* there is an additional handle 50*a*, a tool chuck 52*a*, a tool 54*a* realized as an SDS-plus drilling chisel, and an operating element 56*a*. An operator, not represented in greater detail, can effect a change of operating mode by means of the operating element 56*a*.

Figure 2:
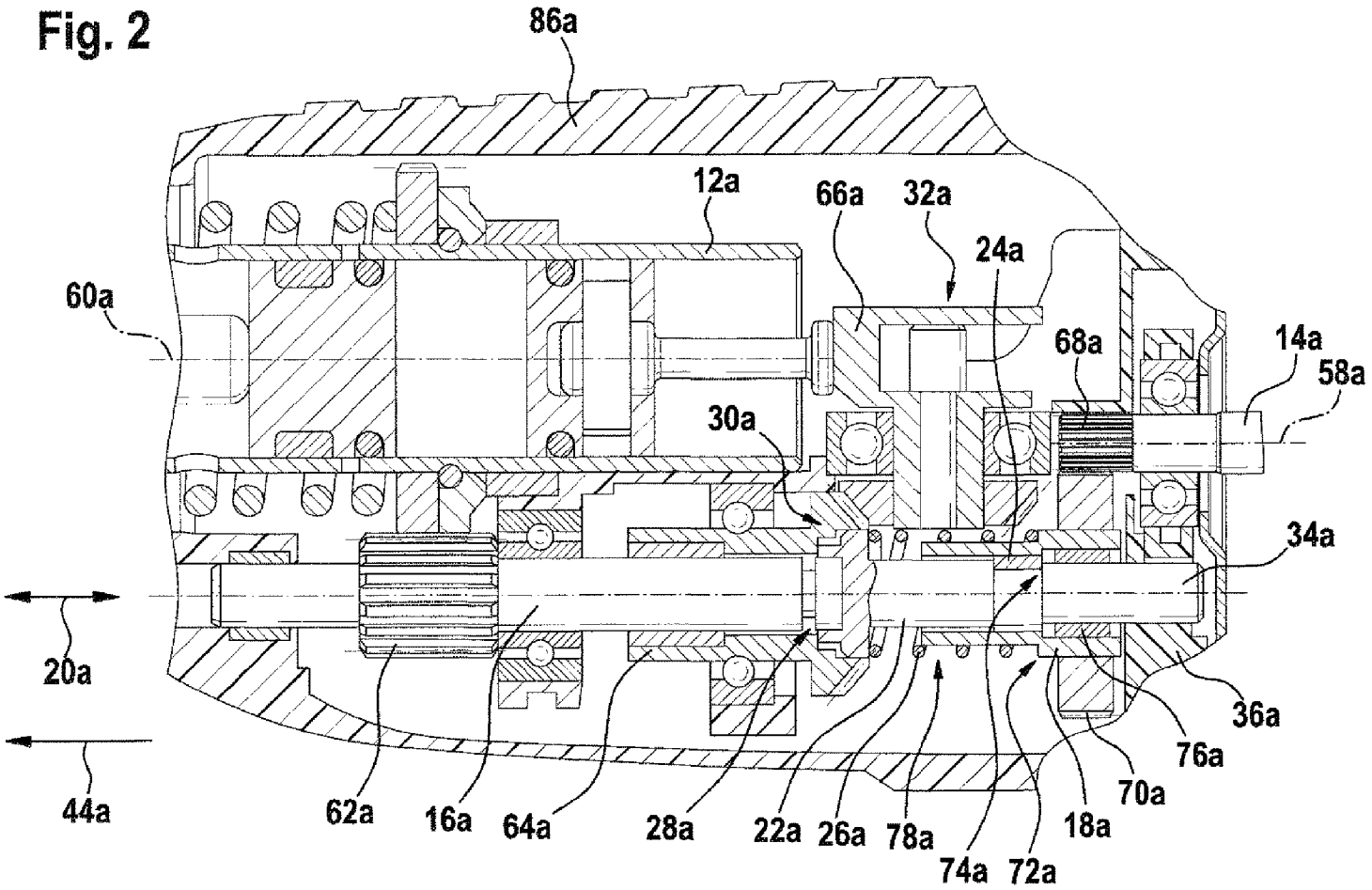
FIG. 2 shows a schematic inside view of the hand-held power tool from FIG. 1 in a first exemplary embodiment.

Shown in FIG. 2 is a schematic representation of an inside view of a transmission arrangement 57*a* of the hand-held power tool 10*a*, which is provided to change the operating mode of the hand-held power tool 10*a*. The hand-held power tool 10*a* has a motor shaft 14*a*, which can be driven by a motor, not represented in greater detail, and a work spindle 12*a*. A rotation axis 58*a* of the motor shaft 14*a* extends parallelwise in relation to the main working direction 44*a* and parallelwise in relation to a rotation axis 60*a* of the work spindle 12*a*. An impulse-generating device, which is represented only partially and which has a stroke generator 32*a*, is accommodated in the work spindle 12*a* and in front of and behind the work spindle 12*a* in the main working direction 44*a*. Further, the hand-held power tool 10*a* has an intermediate shaft 16*a* arranged parallelwise in relation to the work spindle 12*a*. The intermediate shaft 16*a* is disposed in an axially displaceable manner for a change of operating mode by means of the operating element 56*a*, and has an outer toothing 62*a*, which, in at least one operating mode, transmits a torque to the work spindle 12*a*, which is realized as a hammer tube. Furthermore, the hand-held power tool 10*a* has a toothed sleeve 18*a*, which transmits a torque from the motor shaft 14*a* to a switching element 22*a* during an operation.

The toothed sleeve 18*a* is fixed in an axial direction 20*a* relative to the motor shaft 14*a* by means of the hand-held power tool housing 86*a*. For a change of operating mode, the hand-held power tool 10*a* has the switching element 22*a*, which is axially displaceable relative to the toothed sleeve 18*a* for a change of operating mode. A transmission of the torque from the toothed sleeve 18*a* to the switching element 22*a* is effected by means of a coupling element 24*a*, which is realized as a splined-shaft profile and which connects the switching element 22*a* and the toothed sleeve 18*a* to one another in a rotationally fixed manner.

In addition, the hand-held power tool 10*a* has the stroke generator 32*a*, having a transmission element 64*a* and having an eccentric gear 66*a*, and has a spring element 26*a*. At an end lying in the main working direction 44*a*, the motor shaft 14*a* has a toothing 68*a* that, together with the toothing 70*a* of the toothed sleeve 18*a*, constitutes a spur gear transmission. The toothed sleeve 18*a* is realized as a hollow shaft, which has three outer radii that become smaller along the main working directions 44*a*, and two inner radii that become smaller in a radial direction along the main working directions 44*a*. The toothing 70*a* is arranged in the region of the largest outer radius, which is constituted by a ring pressed onto the toothed sleeve 18*a*. A transition 72*a* between the middle and the small outer radius to a support serves, in the axial direction, as a bearing contact surface for the spring element 26*a*. A transition 74*a* between the large and the small inner radius serves as a bearing contact surface for a bearing 76*a*. The bearing 76*a* seats the toothed sleeve 18*a* in a housing element 36*a*, which is indirectly connected to the hand-held power tool housing 86*a* via the bearing element 34*a*. The toothed sleeve 18*a* surrounds the switching element 22*a* in a region 78*a*, which lies in the main working direction 44*a* and extends in the form of a tube, parallelwise in relation to the main working direction 44*a*.

In the case of a change of operating mode between drilling operation and impact drilling operation, the spring element 26*a* displaces the switching element 22*a*, and is realized as a helical spring. For this purpose, the spring element 26*a* bears on the toothed sleeve 18*a* and on the switching element 22*a*, and presses the two elements 18*a*, 22*a* apart from one another in an axial direction. Further, during the chiseling operation and the impact drilling operation, the spring element 26*a* presses the switching element 22*a* against the transmission element 64*a* of the stroke generator 32*a*, and thereby enables a rotationally fixed connection between the switching element 22*a* and the transmission element 64*a*. The spring element 26*a* surrounds the toothed sleeve 18*a* and the switching element 22*a*, partially in each case, in a region that extends, in the form of a tube, parallelwise in relation to the main working direction 44*a*.

The hand-held power tool 10*a* has a first connecting element 28*a*, which, in the case of a drilling operation and an impact drilling operation, connects the intermediate shaft 16*a* and the switching element 22*a* to one another in a rotationally fixed manner. The first connecting element 28*a* is realized as a spline. In the case of a chiseling operation, the intermediate shaft 16*a* is displaced axially in the main working direction 44*a* by means of the operating element 56*a*. As a result, the first connecting element 28*a* opens, in that the intermediate shaft 16*a* is moved away from the switching element 22*a*, and no torque is transmitted to the intermediate shaft 16*a*, and consequently to the work spindle 12*a* and the tool 54*a*.

The hand-held power tool 10*a* has a second connecting element 30*a*, which, in the case of a chiseling operation and an impact drilling operation, connects the switching element 22*a* and the transmission element 64*a* of the stroke generator 32*a* to one another in a rotationally fixed manner. The second connecting element 30*a* is realized as a spline, which is arranged on the switching element 22*a*, on an outer radius in the main working direction 44*a*. In the case of a drilling operation, the intermediate shaft 16*a* is displaced axially contrary to the main working direction 44*a*, by means of the operating element 56*a*. As a result, the intermediate shaft 16*a* likewise displaces the switching element 22*a* contrary to the main working direction 44*a*, against a spring pressure of the spring element 26*a*. As a result, the second connecting element 30*a* opens. No torque is transmitted to the transmission element 64*a* and, consequently, to the stroke generator 32*a*.

Further exemplary embodiments of the disclosure are shown in FIGS. 3, 4 and 6 to 10. To distinguish the exemplary embodiments, the letter a in the references of the exemplary embodiment in FIGS. 1, 2 and 5 is replaced by the letters b to h in the references of the exemplary embodiments in FIGS. 3, 4 and 6 to 10. The following descriptions are limited substantially to the differences between the exemplary embodiments, and reference may be made to the description of the other exemplary embodiments, in particular in FIGS. 1, 2 and 5, in respect of components, features and functions that remain the same.

Figure 3:
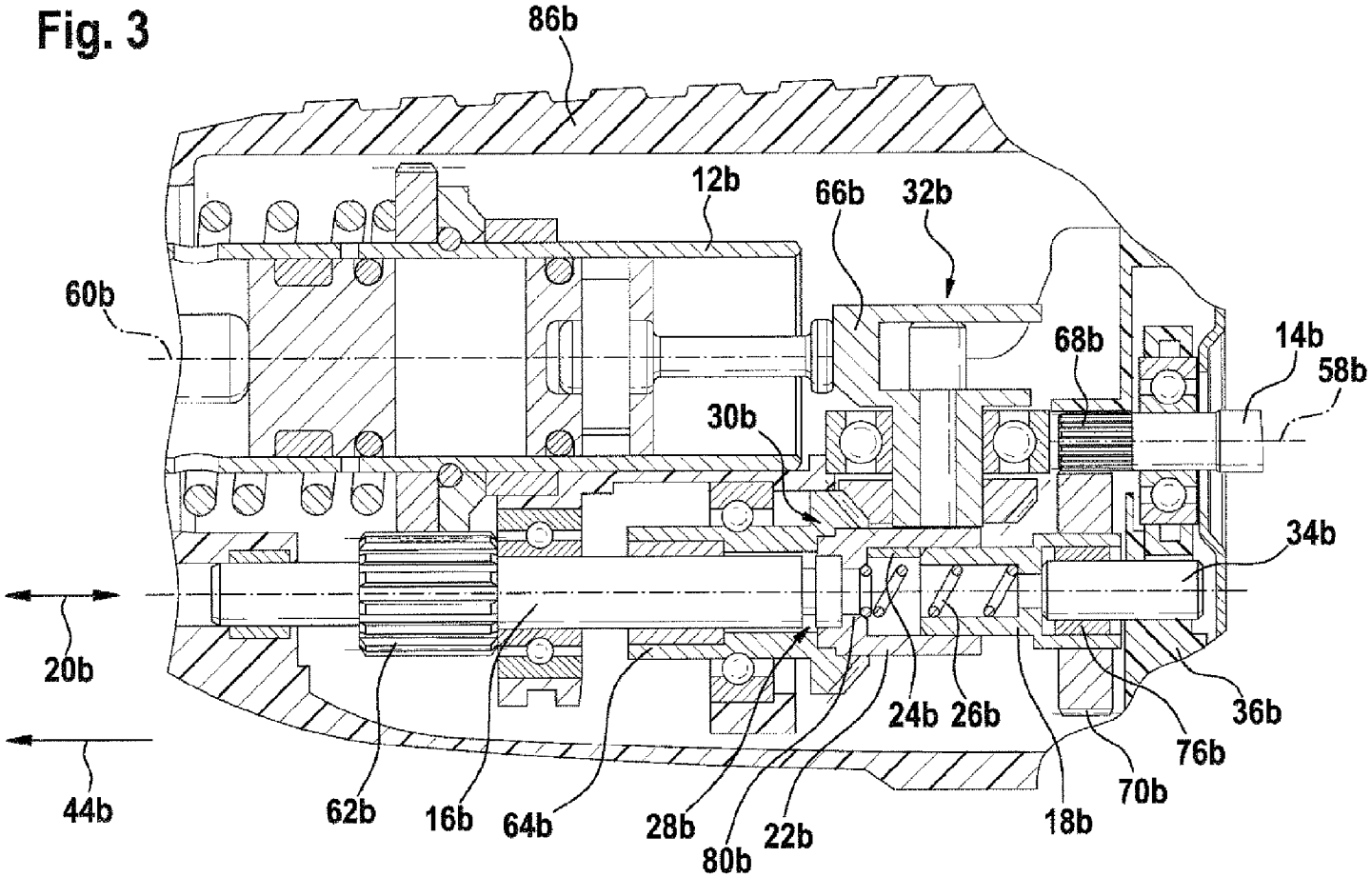
FIG. 3 shows a schematic inside view of the hand-held power tool in a second exemplary embodiment.

FIG. 3 shows a hand-held power tool 10*b*, in which, unlike the first exemplary embodiment in FIG. 2, a spring element 26*b* and a toothed sleeve 18*b* are arranged partially within a switching element 22*b*. The switching element 22*b* in this case partially surrounds the toothed sleeve 18*b*. In this case, the spring element 26*b* is arranged within the toothed sleeve 18*b* and the switching element 22*b*. Webs 80*b* arranged within the toothed sleeve 18*b* and within the switching element 22*b* serve as bearing contact surfaces for the spring element 26*b*.

Figure 4:
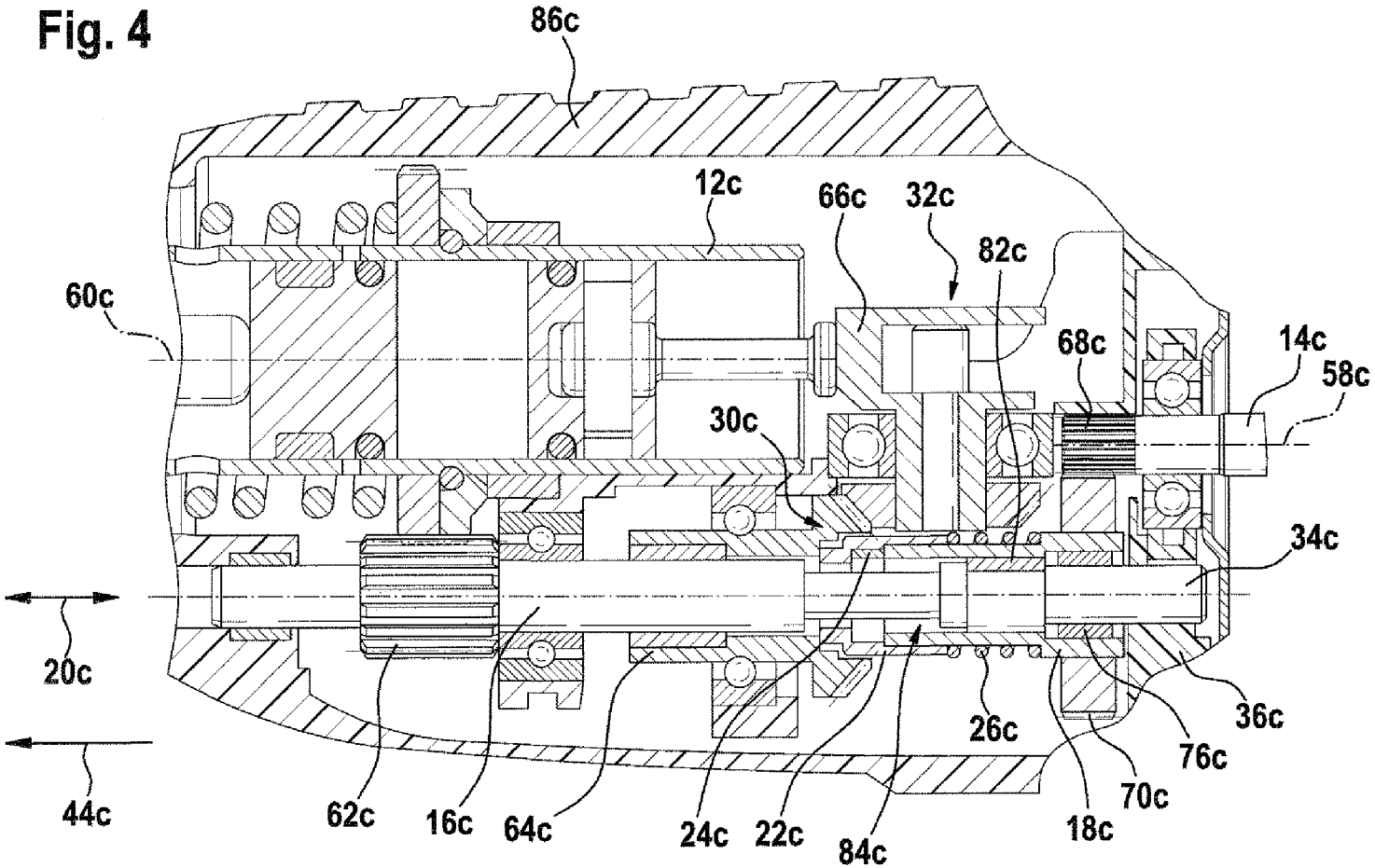
FIG. 4 shows a schematic inside view of the hand-held power tool in a third exemplary embodiment.
Figure 5:
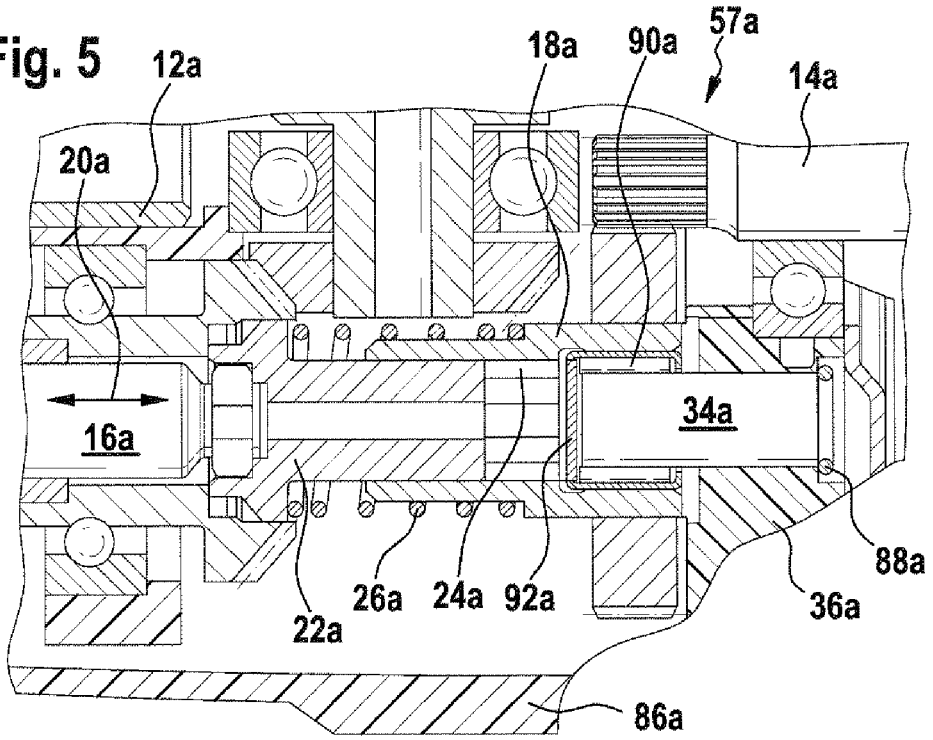
FIG. 5 shows a schematic detail view of a transmission arrangement of the hand-held power tool of the first exemplary embodiment.

Furthermore, FIG. 4 shows a hand-held power tool 10*c*, in which, unlike the first exemplary embodiment in FIG. 2, a first connecting element 82*c* connects a toothed sleeve 18*c* and an intermediate shaft 16*c* in a rotationally fixed manner in the case of a drilling operation or an impact drilling operation. The first connecting element 82*c* is realized as a splined-shaft profile and arranged within the toothed sleeve 18*c*. In this case, a switching element 22*c* is arranged coaxially in relation to the intermediate shaft 16*c*. The switching element 22*c* partially surrounds the toothed sleeve 18*c* in a region extending, in the form of a tube, parallelwise in relation to the main working direction 44*a*. In the case of a drilling operation and an impact drilling operation, the intermediate shaft 16*c* engages in the splined-shaft profile of the toothed sleeve 18*c*. In the case of a chiseling operation, the intermediate shaft 16*c* is displaced, and moves in a region 84*c* of the toothed sleeve 18*c* that has no splined shaft. In this case, no torque is transmitted from the toothed sleeve 18*c* to the intermediate shaft 16*c*.

FIG. 5 shows a detail representation of the seating of the toothed sleeve 18*a* of the first exemplary embodiment from FIG. 2. For the purpose of seating the toothed sleeve 18*a*, the transmission arrangement 57*a* has the additional bearing element 34*a*, which is realized as a stud. The bearing element 34*a* is pressed into the housing element 36*a*, which is realized as an intermediate flange, and is thereby connected to the hand-held power tool housing 86*a*. Axially, the bearing element 34*a* is secured by means of a snap ring 88*a*.

For the purpose of radially seating the toothed sleeve 18*a*, the transmission arrangement 57*a* has a needle bearing 90*a*, which is arranged coaxially in relation to the toothed sleeve 18*a*, between the bearing element 34*a* and the toothed sleeve 18*a*. Axially, the toothed sleeve 18*a* is seated by means of a washer 92*a* inserted in the toothed sleeve 18*a*. The needle bearing 90*a* and the washer 92*a* can be realized in an integral manner.

Figure 6:
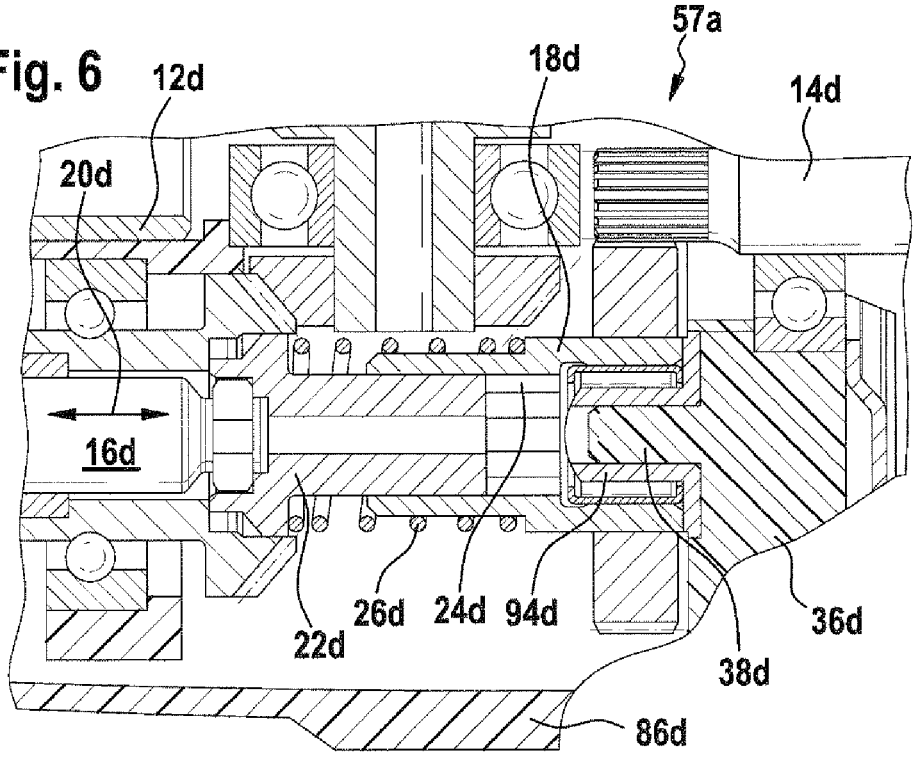
FIG. 6 shows a schematic detail view of the transmission arrangement in a fourth exemplary embodiment.

Further, FIG. 6 shows an alternative seating of a toothed sleeve 18*d*. In this case, a journal 38*d* is provided instead of a stud as in FIG. 5. The journal 38*d* is made from light metal, realized so as to be integral with a housing element 36*d*, and is thus connected to a hand-held power tool housing 86*d*. An axial and radial seating is effected by means of an integral sheet-metal cup 94*d*, which extends axially along the journal 38*d* and radially along the housing element 36*d*. Alternatively, it is possible for the sheet-metal cup 94*d* to be realized in multiple parts, as a sleeve and as a washer.

Figure 7:
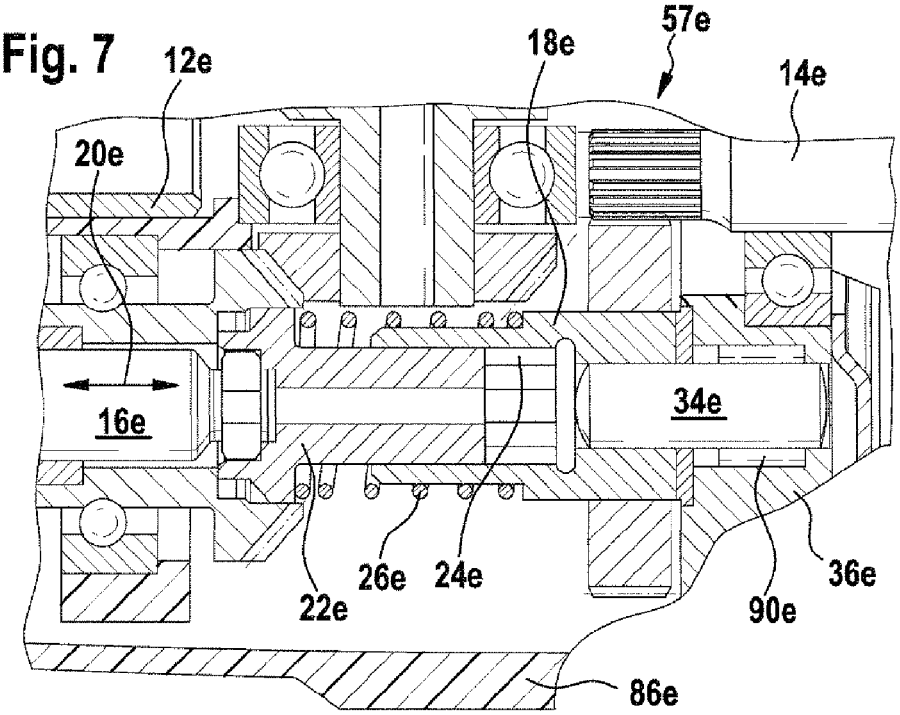
FIG. 7 shows a schematic detail view of the transmission arrangement in a fifth exemplary embodiment.

In an exemplary embodiment shown in FIG. 7, a bearing element 34*e* realized as a stud is pressed into a toothed sleeve 18*e*. For the purpose of radial seating, a transmission arrangement 57*e* has a needle bearing 90*e*, which is arranged between the bearing element 34*e* and a housing element 36*e* that is realized as an intermediate flange and connected to a hand-held power tool housing 86*e*.

Figure 8:
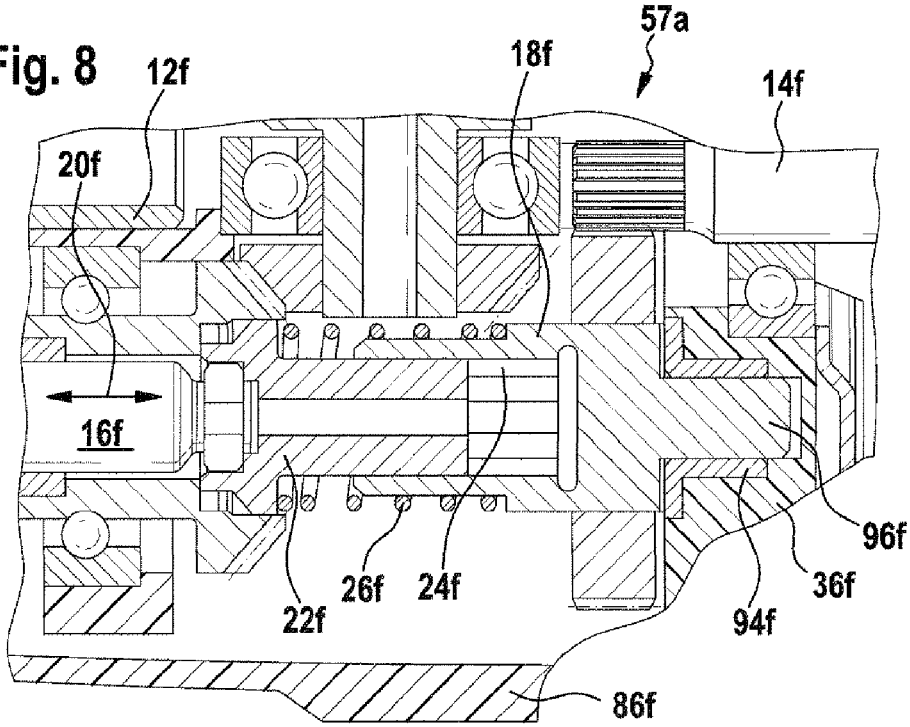
FIG. 8 shows a schematic detail view of the transmission arrangement in a sixth exemplary embodiment.

Furthermore, FIG. 8 shows an exemplary embodiment in which a journal 96*f* is formed onto a toothed sleeve 18*f*. The journal 96*f* and the toothed sleeve 18*f* are thus realized in an integral manner. An axial and radial seating is effected by means of a sheet-metal cup 94*f*, which extends axially along the journal 96*f* and radially along the housing element 36*f*, which is connected to a hand-held power tool housing 86*f*.

Figure 9:
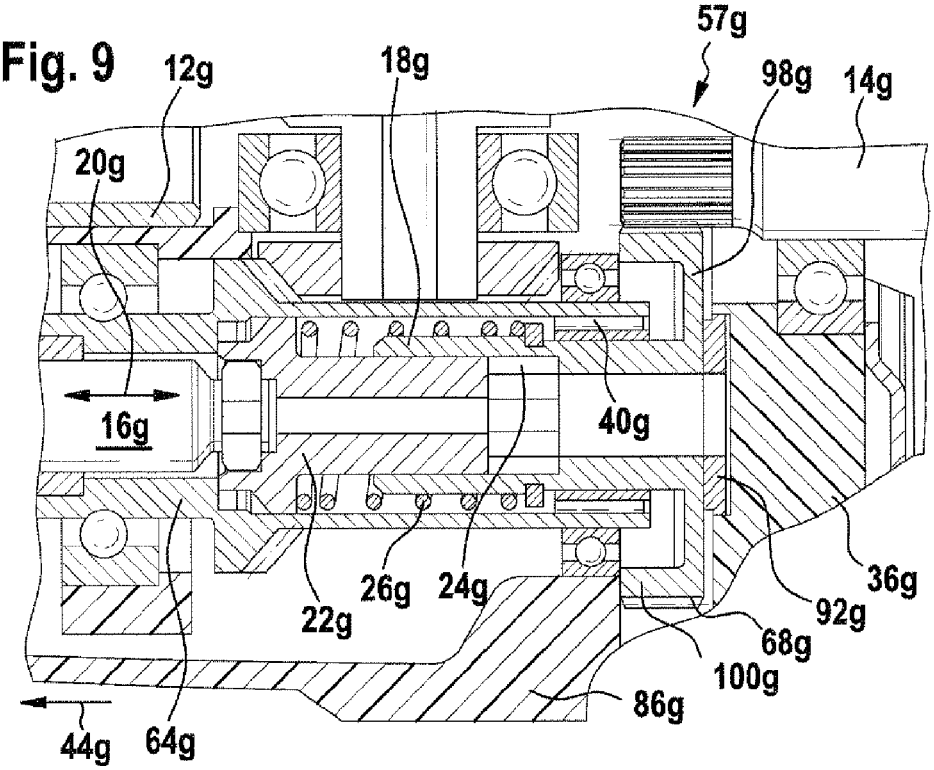
FIG. 9 shows a schematic detail view of the transmission arrangement in a seventh exemplary embodiment.

A further exemplary embodiment is shown by FIG. 9. In the case of the exemplary embodiment, a toothed sleeve 18*g* has, on a side that is contrary to the main working direction 44*g*, an extension 98*g* that extends in the radial direction and that includes an offset portion 100*g* in the main working direction 44*g*. The offset portion 100*g* has a toothing 68*g*, which is meshed with a motor shaft 14*g*. By means of a bearing 40*g* that is realized as a plain bearing, the toothed sleeve 18*g* is seated in a transmission element 64*g* of a stroke generator 32*g*, which is realized as a wobble bearing. Axially, the toothed sleeve 18*g* is seated against a housing element 36*g*, and thus against a hand-held power tool housing 86*g*, by means of a washer 92*g*.

Figure 10:
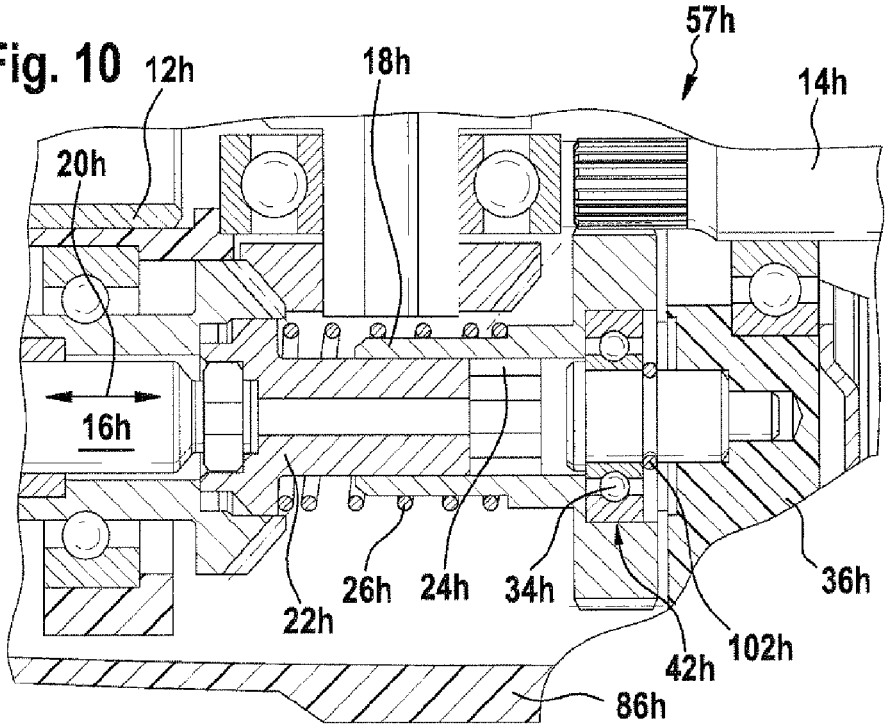
FIG. 10 shows a schematic detail view of the transmission arrangement in an eighth exemplary embodiment.

FIG. 10 shows a bearing 42*h*, which is arranged within a toothed sleeve 18*h* and pressed into the toothed sleeve 18*h*, and which is realized as a deep-groove ball bearing. The bearing 42*h* is fixed axially with a retaining ring 102*h* on an additional bearing element 34*h* that is realized as a shoulder screw, and is thereby seated against a housing element 36*h* and a hand-held power tool housing 86*h*.

The invention claimed is:

1. A hand-held power tool, comprising:

a work spindle;

a hand-held power tool housing;

a motor shaft arranged parallelwise in relation to the work spindle;

an intermediate shaft that is arranged parallelwise in relation to the work spindle and mounted in an axially displaceable manner for a change of operating mode, and having a toothed sleeve configured to transmit a torque to the intermediate shaft, the toothed sleeve being fixed in the axial direction by the hand-held power tool housing;

a switching element, which is axially displaceable relative to the toothed sleeve for at least one change of operating mode; and a coupling element connecting the switching element and the toothed sleeve to one another in a rotationally fixed manner irrespective of an axial displacement of the switching element and the toothed sleeve relative to one another, wherein the intermediate shaft and the switching element are configured to be axially displaceable relative to one another to change the operating mode.

2. The hand-held power tool as claimed in claim 1, further comprising a connecting element, which connects the intermediate shaft and the switching element to one another in a rotationally fixed manner in at least one operating mode.

3. The hand-held power tool as claimed in claim 1, wherein a connecting element is opened in the case of a chiseling operation.

4. The hand-held power tool as claimed in claim 1, further comprising a connecting element, which, in at least one operating mode, transmits at least a torque from the switching element to a stroke generator.

5. The hand-held power tool as claimed in claim 1, further comprising an additional bearing element configured to seat at least the toothed sleeve.

6. The hand-held power tool as claimed in claim 5, wherein the additional bearing element is at least connected to a housing element in a rotationally fixed manner.

7. The hand-held power tool as claimed in claim 1, further comprising a journal, which is integral with a housing element and configured to seat at least the toothed sleeve.

8. The hand-held power tool as claimed in claim 1, further comprising a bearing, which seats at least the toothed sleeve in a stroke generator.

9. The hand-held power tool as claimed in claim 1, wherein the toothed sleeve has a journal.

10. The hand-held power tool as claimed in claim 1, wherein the coupling element includes a splined-shaft profile.

11. A hand-held power, comprising:

a work spindle;

a hand-held power tool housing;

a motor shaft arranged parallelwise in relation to the work spindle;

an intermediate shaft that is arranged parallelwise in relation to the work spindle and mounted in an axially displaceable manner for a change of operating mode, and having a toothed sleeve configured to transmit a torque to the intermediate shaft, the toothed sleeve being fixed in the axial direction by the hand-held power tool housing;

a switching element, which is axially displaceable relative to the toothed sleeve for at least one change of operating mode; and a coupling element connecting the switching element and the toothed sleeve to one another in a rotationally fixed manner irrespective of an axial displacement of the switching element and the toothed sleeve relative to one another, wherein the toothed sleeve at least partially surrounds the switching element.

12. A hand-held power tool, comprising:

a work spindle;

a hand-held power tool housing;

a motor shaft arranged parallelwise in relation to the work spindle;

an intermediate shaft that is arranged parallelwise in relation to the work spindle and mounted in an axially displaceable manner for a change of operating mode, and having a toothed sleeve configured to transmit a torque to the intermediate shaft, the toothed sleeve being fixed in the axial direction by the hand-held power tool housing;

a switching element, which is axially displaceable relative to the toothed sleeve for at least one change of operating mode;

a coupling element connecting the switching element and the toothed sleeve to one another in a rotationally fixed manner irrespective of an axial displacement of the switching element and the toothed sleeve relative to one another; and a spring element that at least partially surrounds the toothed sleeve.

13. The hand-held power tool as claimed in claim 12, wherein the spring element is configured to displace at least the switching element at least in the case of a change of operating mode.

14. The hand-held power tool as claimed in claim 12, wherein:

the toothed sleeve includes a first surface against which a first end of the spring abuts; and the switching element includes a second surface against which a second end of the spring element abuts such that the spring element biases the switching element in a direction away from the toothed sleeve.

* * * * *